US010185257B2

(12) United States Patent
Hasegawa

(10) Patent No.: US 10,185,257 B2
(45) Date of Patent: Jan. 22, 2019

(54) IMAGE FORMING APPARATUS THAT PERFORMS POSITION SWITCHING CONTROL OF A CONVEYANCE GUIDE BASED ON AT LEAST ONE OF SHEET DETECTION AND TEMPERATURE DETECTION

(71) Applicant: KONICA MINOLTA, INC., Chiyoda-ku, Tokyo (JP)

(72) Inventor: Satoshi Hasegawa, Tokokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/248,277

(22) Filed: Aug. 26, 2016

(65) Prior Publication Data

US 2017/0060049 A1 Mar. 2, 2017

(30) Foreign Application Priority Data

Aug. 31, 2015 (JP) ..... 2015-170493

(51) Int. Cl.

*G03G 21/20* (2006.01)
*G03G 15/20* (2006.01)
*G03G 15/23* (2006.01)
*G03G 15/00* (2006.01)

(52) U.S. Cl.

CPC ..... *G03G 15/2039* (2013.01); *G03G 15/234* (2013.01); *G03G 15/6573* (2013.01); *G03G 21/206* (2013.01); *G03G 2215/00721* (2013.01)

(58) Field of Classification Search

CPC ..... G03G 15/2028; G03G 15/2039
USPC ..... 399/33
See application file for complete search history.

(56) References Cited

U.S. PATENT DOCUMENTS 4,655,582 A * 4/1987 Okuda ..... G03G 15/234 399/364
5,732,309 A * 3/1998 Okuno ..... G03G 15/2003 399/320
7,699,312 B2 * 4/2010 Fukuda ..... B41J 13/009 271/184

(Continued)

FOREIGN PATENT DOCUMENTS

JP 06149121 A 5/1994
JP 06348158 A 12/1994

(Continued)

OTHER PUBLICATIONS

Japanese Office Action (and English translation thereof) dated Jun. 27, 2017 issued in counterpart Japanese Application No. 2015-170493.

(Continued)

*Primary Examiner* — Quana M Grainger
(74) *Attorney, Agent, or Firm* — Holtz, Holtz & Volek PC

(57) ABSTRACT

An image forming apparatus includes: an image forming device that forms an image on a sheet; a fixing device that fixes the image to the sheet; a temperature sensor that detects a temperature of the fixing device; a conveyance guide located at a predetermined position that blocks wind flowing into the fixing device; a detector that detects the sheet passing through the conveyance guide; and a hardware processor that switches the conveyance guide to the predetermined position based on a detection result of the detector.

12 Claims, 11 Drawing Sheets

(56) References Cited

U.S. PATENT DOCUMENTS

| | | | | |
|---|---|---|---|---|
| 8,254,802 | B2 * | 8/2012 | Hanashi | G03G 15/2039 165/59 |
| 2006/0008283 | A1 * | 1/2006 | Oohara | G03G 15/2028 399/45 |
| 2011/0217054 | A1 * | 9/2011 | Ito | G03G 15/20 399/18 |
| 2012/0099875 | A1 * | 4/2012 | Yagi | B65H 29/14 399/16 |
| 2014/0126944 | A1 * | 5/2014 | Kimura | G03G 15/6552 399/405 |

FOREIGN PATENT DOCUMENTS

| | | | | |
|---|---|---|---|---|
| JP | 2006133318 | A | * | 5/2006 |
| JP | 2007047496 | A | * | 2/2007 |
| JP | 2013064790 | A | | 4/2013 |
| JP | 2015099188 | A | | 5/2015 |

OTHER PUBLICATIONS

Japanese Office Action dated Oct. 3, 2017 issued in counterpart Japanese Application No. 2015-170493.

* cited by examiner

IMAGE FORMING APPARATUS THAT PERFORMS POSITION SWITCHING CONTROL OF A CONVEYANCE GUIDE BASED ON AT LEAST ONE OF SHEET DETECTION AND TEMPERATURE DETECTION

The entire disclosure of Japanese Patent Application No. 2015-170493 filed on Aug. 31, 2015 including description, claims, drawings, and abstract are incorporated herein by reference in its entirety.

BACKGROUND OF THE INVENTION

Field of the Invention

An embodiment of the present invention relates to an image forming apparatus including an image forming device that forms an image on paper, a fixing device that fixes the formed image on the paper, a temperature sensor that detects a temperature of the fixing device, and a control unit that switches a position of a conveyance guide in order to switch a conveyance path of the paper. The image forming apparatus includes various kinds of apparatuses such as a copier, printer, a facsimile, and a multifunction printer comprehensively including functions of these.

Description of the Related Art

An electrophotographic image forming apparatus transfers, onto paper, a toner image formed by an image forming device including a photoconductor drum, an exposure device, a developing device, and the like, makes the paper pass through a fixing device including a fixing roller, and fixes the toner image on the paper. The fixing roller is heated with a heating unit such as an electrothermal heater or an induction heater and fixes a toner image on paper by heating and pressing the paper on which the toner image is transferred.

A temperature sensor that detects a temperature of a fixing device, specifically a surface temperature of a fixing roller is provided. Feedback control of the heating unit is performed based on the detection temperature. That is, temperature adjustment control of keeping a surface temperature of the fixing roller at a target temperature is performed. Recently, a contactless thermistor temperature sensor is often used as such a temperature sensor.

Compared to a contact temperature sensor, it is possible to reduce a load on a fixing roller and to increase a life of the fixing roller in the contactless temperature sensor. That is, in a case of the contact temperature sensor, there is a disadvantage that a mark of contact of a temperature sensor is easily left on a surface of a fixing roller. However, there is not such a disadvantage in the contactless temperature sensor. However, generally, the contactless temperature sensor has a weak point that a detection temperature is influenced by surrounding wind and becomes lower than an actual temperature. In order to prevent this, it is necessary, for example, to surround the temperature sensor with a protection against wind.

Furthermore, recently, there is a high demand for a small image forming apparatus that can be provided anywhere. Such a small image forming apparatus is placed in various places including a deskside when being used. Depending on a provided place, there is a case where wind from an air outlet of an air-conditioner or from an electric fan (or circulator) flows into an inner part from a paper ejection opening of an image forming apparatus and a detection temperature in a temperature sensor in a fixing device and temperature adjustment control of a fixing roller are influenced badly.

Specifically, as a result of downsizing of an image forming apparatus, a paper conveyance path from a fixing device to a paper ejection opening becomes short. Thus, even in a contactless temperature sensor surrounded by a protection against wind, there is a case where temperature detection by a temperature sensor is not performed correctly due to an influence of wind flowing from the outside.

On the other hand, in JP 2015-99188 A, an image forming apparatus in which a shutter member, on which opening/closing control is performed, is provided in a paper ejection opening is described. The opening/closing control of the shutter member is performed in order to keep a thermal insulation state of a fixing device. That is, the opening/closing control of the shutter member is performed according to actuation/stoppage of a cooling fan.

It is considered to block wind, which flows from a paper ejection opening of an image forming apparatus into an inner part thereof, by using a shutter member of the image forming apparatus described in JP 2015-99188 A. That is, it is possible to prevent a flow of wind from the paper ejection opening into the inner part by closing the shutter member with a purpose different from a purpose described in JP 2015-99188 A, that is, with a purpose of preventing failure in correct temperature detection, which is performed by a temperature sensor, due to wind flowing from the outside. However, in this case, a shutter member and a mechanism that opens/closes that become necessary and a cost of the image forming apparatus is increased.

On the other hand, there are many image forming apparatuses that can perform duplex printing. In those image forming apparatuses, a path switching gate that can switch conveyance of paper after single-sided printing to a reverse conveyance path and conveyance of paper after duplex printing to a paper ejection opening is included in a conveyance path of paper. Alternatively, there is an image forming apparatus which includes a sheet postprocessing device to bundle a plurality of pieces of paper elected from a paper ejection opening and to perform postprocessing such as stapling processing and in which a lowered position and an elevated position of a postprocessing tray are switched.

SUMMARY OF THE INVENTION

An object of the present invention is to provide an image forming apparatus in which wind flowing into a fixing device from a paper ejection opening is blocked and temperature detection is performed correctly by a temperature sensor without addition of a new member by utilization of the above-described path switching gate for duplex printing or a postprocessing tray of a sheet postprocessing device and by appropriate performance of position switching control thereof.

To achieve the abovementioned object, according to an aspect, an image forming apparatus reflecting one aspect of the present invention comprises: an image forming device that forms an image on a sheet; a fixing device that fixes the image to the sheet; a temperature sensor that detects a temperature of the fixing device; a conveyance guide located at a predetermined position that blocks wind flowing into the fixing device; a detector that detects the sheet passing through the conveyance guide; and a hardware processor that switches the conveyance guide to the predetermined position based on a detection result of the detector.

According to the image forming apparatus of Item. 2, in the image forming apparatus of Item. 1, the hardware processor preferably switches the conveyance guide to the predetermined position based on the detection result of the detector and a detection temperature of the temperature sensor.

According to the image forming apparatus of Item. 3, in the image forming apparatus of Item. 1, the image forming apparatus further preferably comprises a reverse conveyance path and a paper ejection opening, the conveyance guide is preferably a path switching gate that conveys the paper to the reverse conveyance path when being at a first position and that conveys the paper to the paper ejection opening when being at a second position, and the predetermined position is preferably the first position.

According to the image forming apparatus of Item. 4, in the image forming apparatus of Item. 1, the image forming apparatus further preferably comprises a paper ejection opening, the conveyance guide is preferably a postprocessing device that performs predetermined postprocessing on the paper ejected from the paper ejection opening, the postprocessing device preferably receives the paper ejected from the paper ejection opening when being at a lowered position and performs the predetermined postprocessing at an elevated position, and the predetermined position is preferably the elevated position.

According to the image forming apparatus of Item. 5, in the image forming apparatus of Item. 2, the hardware processor preferably switches the conveyance guide to the predetermined position in a case where a state in which the detection temperature is lower than a target temperature for a predetermined temperature lasts for a predetermined period.

According to the image forming apparatus of Item. 6, in the image forming apparatus of Item. 5, the image forming apparatus further preferably comprises an alarm, the hardware processor preferably prompts, with the alarm, to change a place where the image forming apparatus is provided in a case where a detection temperature of the temperature sensor reaches the target temperature in a predetermined period after the conveyance guide is switched to the predetermined position.

According to the image forming apparatus of Item. 7, in the image forming apparatus of Item. 5, the image forming apparatus further preferably comprises an alarm, the hardware processor preferably stops a temperature adjustment of the fixing device and notifies an abnormal state with the alarm in a case where a detection temperature of the temperature sensor does not reach the target temperature in a predetermined period after the conveyance guide is switched to the predetermined position.

According to the image forming apparatus of Item. 8, in the image forming apparatus of Item. 3, the image forming apparatus further preferably comprises a conveyance path for a switchback.

According, to the image forming apparatus of Item. 9, in the image forming apparatus of Item. 8, the image forming apparatus further preferably comprises a paper exit/entrance of the conveyance path for a switchback, the conveyance guide is preferably kept at the first position under a predetermined condition and the paper is ejected from the paper exit/entrance.

According to the image forming apparatus of Item. 10, in the image forming apparatus of Item. 3, the hardware processor preferably performs switching in a predetermined cycle.

According to the image forming apparatus of Item. 11, in the image forming apparatus of Item. 3, the hardware processor preferably switches, based on the detection result of the detector, the path switching gate to the first position until a rear end of the paper moves for 20 mm after passing through the path switching gate.

According to the image forming apparatus of Item. 12, in the image forming apparatus of Item. 3, the image forming apparatus further preferably comprises a solenoid, the hardware processor preferably switches the path switching gate to the second position by performing energization of the solenoid and switches the path switching gate to the first position by stopping the energization of the solenoid.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
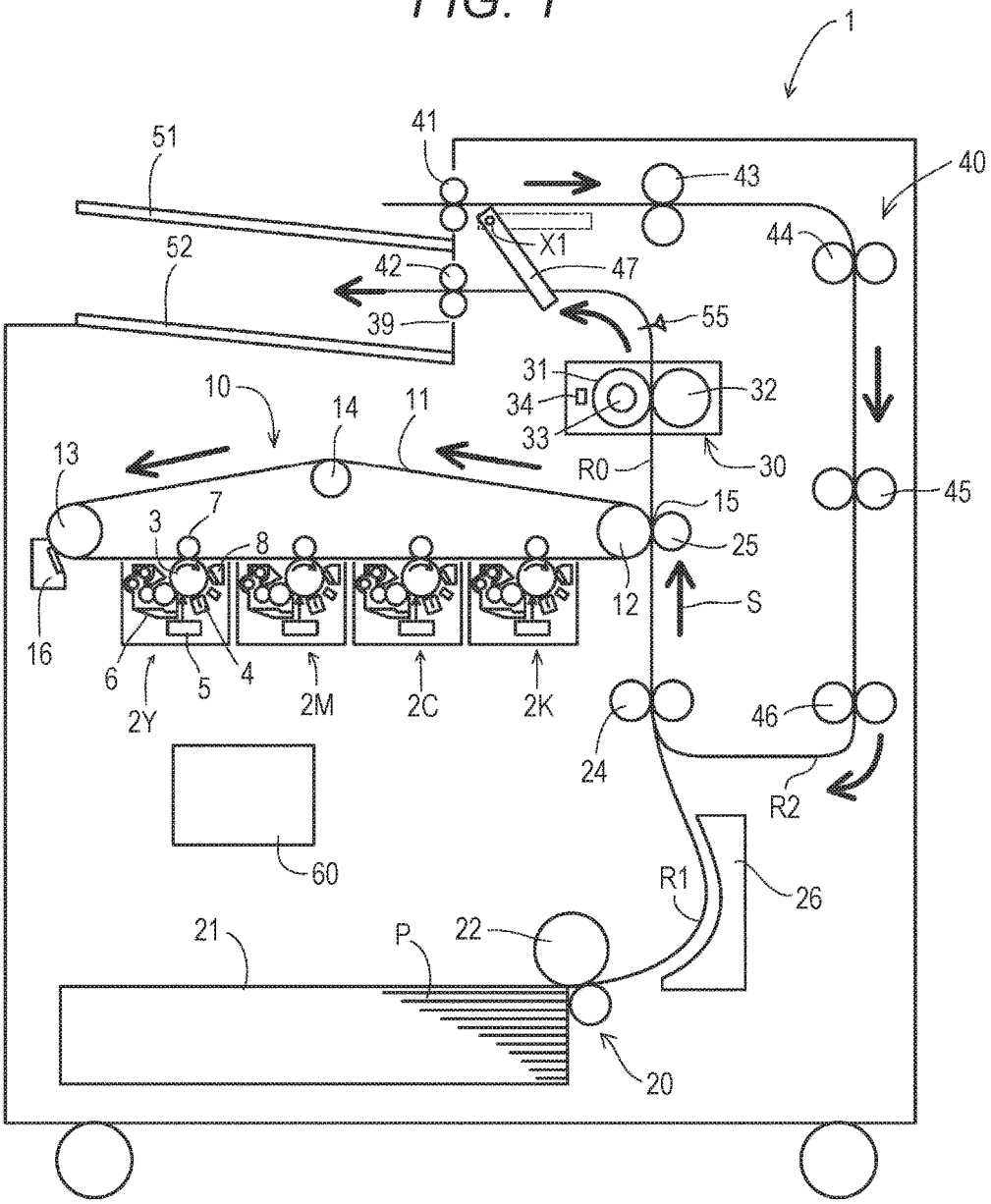
FIG. 1 is a schematic configuration view illustrating a whole configuration of an image forming apparatus according to a first embodiment of the present invention.

Hereinafter, an image forming apparatus according to embodiments of the present invention will be described with reference to the drawings. However, the scope of the invention is not limited to the illustrated examples. First, a schematic configuration of an image forming apparatus according to a first embodiment is illustrated in FIG. 1. This image forming apparatus is a tandem-type color digital printer (hereinafter, referred to as printer) and an outline of an inner configuration of when a printer 1 is seen from the front is illustrated in FIG. 1.

The printer 1 has a circulation-type duplex printing function and includes an image processing unit (image forming device) 10, a feeding unit 20, a fixing device 30, a circulation conveyance unit 40, a control unit 60, and the like in an inner part thereof. The printer 1 is configured to execute a print job based on a print instruction, for example, when receiving the print instruction from an external terminal or the like through network connection. A print job includes a job of single-sided printing in which printing (image forming) is performed on one surface of a recording material (paper) P and a job of duplex printing in which printing is performed on both of rear and front surfaces of a recording material P.

The image processing unit 10 has a function of transferring a toner image, which is formed on a photoreceptor drum 3 that is an example of an image carrier, onto the recording material P and includes four image forming units 2 corresponding to colors of yellow (Y), magenta (M), cyan (C), and black (K) and an intermediate transfer belt 11. The four image forming units 2 are arranged on a lower side of the intermediate transfer belt 11 along the intermediate transfer belt 11 in order of yellow, magenta, cyan, and black from the left side in FIG. 1. Each image forming unit 2 includes the photoreceptor drum 3 that is driven rotationally in a clockwise direction in FIG. 1. Around the photoreceptor drum 3, a charging unit 4, an exposure unit 5, a developing unit 6, a primary transfer roller 7, and a photoreceptor cleaner 8 are serially arranged in a rotational direction thereof (clockwise direction in FIG. 1). Note that for convenience of a description, signs Y, M, C, and K corresponding to reproduction colors are assigned to the image forming units 2 in FIG. 1. Furthermore, in the image forming units 2M to 2K other than the image forming unit 2Y for yellow, signs 3 to 8 of configuration elements such as the photoreceptor drum 3 are omitted.

The intermediate transfer belt 11 is also an example of an image carrier and is wound around a drive roller 12, a driven roller 13, and a tension roller 14. The intermediate transfer belt 11 is driven rotationally in a counterclockwise direction in FIG. 1. On an outer side of a part of the intermediate transfer belt 11 which part is wound around the drive roller 12, a secondary transfer roller 25 that is a configuration element of the feeding unit 20 is arranged. At a part where the intermediate transfer belt 11 and the secondary transfer roller 25 abut to each other is a secondary transfer position 15. On an outer side of a part of the intermediate transfer belt 11 which part is wound around the driven roller 13, a transfer belt cleaner 16 to remove untransferred toner on the intermediate transfer belt 11 is arranged.

The feeding unit 20 includes a paper cassette 21 that houses the recording material P, a pair of paper feeding rollers 22 that sends out the recording material P in the paper cassette 21 one by one toward a main conveyance path R0, a pair of resist rollers 24 that measures timing of feeding the sent recording material P to the secondary transfer position 15, the secondary transfer roller 25, and the like. The recording material P from the paper cassette 21 is fed to the main conveyance path R0 through a paper feeding path R1 by rotational driving of the pair of paper feeding rollers 22. The paper feeding path R1 is connected to the main conveyance path R0 on a conveyance upstream side of the pair of resist rollers 24 and a circulation conveyance path R2 (described later) joins this place.

The fixing device 30 includes a fixing roller 31 including a fixing heater 33 such as a halogen lamp, and a pressing roller 32 facing the fixing roller 31. The recording material P on which a toner image is transferred is heated/pressed when passing through a fixing nip that is a part where the fixing roller 31 and the pressing roller 32 abut to each other, whereby the toner image is fixed on the recording material P. Furthermore, a temperature sensor (contactless thermistor temperature sensor) 34 that detects a surface temperature of the fixing roller 31 without contact is provided, and the control unit 60 performs energization control of the fixing heater 33 based on a detection temperature thereof. That is, temperature adjustment control (feedback control) of keeping a surface temperature of the fixing roller 31 at a target temperature is performed.

The circulation conveyance unit 40 is a reverse conveyance unit that reverses front and rear sides of the recording material P after single-sided printing. The circulation conveyance unit 40 includes a pair of reverse rollers 41 that is provided separately from a pair of ejection rollers 42 that is an ejection unit of ejecting a recording material P on which printing is already performed, and a plurality of pairs of duplex conveyance rollers 43 to 46. The circulation conveyance unit 40 reverses front and rear sides of the recording material P after the single-sided printing and conveys the material to the pair of resist rollers 24 again through the circulation conveyance path (reverse conveyance path) R2. The pair of reverse rollers 41 is configured rotatably in normal and reverse directions. The recording material P can be sent to the outside of the printer 1 or can be brought back to the printer 1 by a switchback. Note that on an upper part of the printer 1, a housing tray 51 with respect to the pair of reverse rollers 41 and a paper ejection tray 52 with respect to the pair of ejection rollers 42 are provided. The recording material P on which printing is already performed is generally ejected onto the paper ejection tray 52 by rotational driving of the pair of ejection rollers 42. However, the recording material P on which printing 15 already performed may be ejected onto the housing tray 51 by rotational driving of the pair of reverse rollers 41.

A terminal side of the main conveyance path R0 is extended in a substantially horizontal direction toward the pair of ejection rollers 42. On the other hand, a beginning side of the circulation conveyance path R2 is extended in a substantially horizontal direction toward the pair of reverse rollers 41. The terminal side of the main conveyance path R0 and the beginning side of the circulation conveyance path R2 are arranged in a substantially parallel manner on upper and lower sides. Between the terminal side of the main conveyance path R0 and the beginning side of the circulation conveyance path R2, a plate-like path switching gate 47 to switch whether to send the recording material P to the pair of reverse rollers 41 or to the pair of ejection rollers 42 is provided. That is, the path switching gate 47 is switched between a first position of conveying the recording material P to a reverse conveyance path and a second position of conveying the material to a paper ejection opening 39.

As illustrated in FIG. 1, the path switching gate 47 is pivotally supported by a housing in a swingable manner around a horizontal axis X1 in a vicinity of the pair of reverse rollers 41 and is switched from a second position (horizontal position) indicated by a dashed-two dotted line to a first position indicated by a solid line by excitation of a solenoid 70 (see FIG. 2), which is an actuator, performed by the control unit 60. Alternatively, when the control unit 60 stops the excitation of the solenoid, the path switching gate 47 goes back to the second position.

When the path switching gate 47 is at the first position, a state becomes a state in which the terminal side of the main conveyance path R0 is closed and the beginning side of the circulation conveyance path R2 is connected to the main conveyance path R0 (state of guiding recording material P toward pair of reverse roller 41). When the path switching gate 47 is at the second position, a state becomes a state in which the terminal side of the main conveyance path R0 is opened and the beginning side of the circulation conveyance path R2 and the main conveyance path R0 are separated from each other.

In a case of performing duplex printing, the recording material P after single-sided printing is conveyed toward the pair of reverse rollers 41 by the path switching gate 47 at the first position and is sent to the outside (upper side of paper ejection tray 52) in a state of being sandwiched by the pair of reverse rollers 41. Then, the recording material P is conveyed toward the circulation conveyance path R2 by a switchback operation of reversing a rotational direction of the pair of reverse rollers 41. Here, the path switching gate 47 is switched to the second position and the terminal side of the main conveyance path R0 and the beginning side of the circulation conveyance path R2 are separated from each other. The recording material P conveyed in an arrow direction in the circulation conveyance path R2 joins the main conveyance path R0 on a terminal side of the circulation conveyance path R2 (upstream side of pair of resist roller 24) and is sent to the secondary transfer position 15 again.

When the recording material P passes through the secondary transfer position 15 again, front and rear sides (front and rear end) thereof are reversed from those in the first passage. Recording material P on a rear surface of which a toner image is also transferred passes through the fixing device 30 again and the toner image on the rear surface is also fixed to the recording material P. The recording material P on which the duplex printing is performed in such a manner is conveyed toward the paper election opening 39 including the pair of ejection rollers 42. Here, the path switching gate 47 is switched to the second position.

Note that paper sensors (such as photosensor) 55 that are examples of a detector to detect existence of the recording material (paper) P are arranged in a plurality of places (at predetermined interval) in the paper conveyance path, that is, in the paper feeding path R1, the main conveyance path R0, and the circulation conveyance path R2. In FIG. 1, a paper sensor 55 is illustrated as a representative of these on a downstream side of the fixing device 30. A detection signal from each paper sensor 55 is input into the control unit 60. The control unit 60 can determine timing, at which a front end or a rear end of the recording material P passes, based on the detection signal from the paper sensor 55. Furthermore, it is possible to determine whether there is the recording material (paper) P in the paper conveyance path. Timing at which the control unit 60 switches the first position and the second position of the path switching gate 47 through the solenoid is appropriately determined by the control unit 60 based on the detection signal from the paper sensor 55 and a built-in timer 61 (see FIG. 2) in the control unit 60. A detail will be described later.

As described above, a main function of the path switching gate 47 is to switch a conveyance path of the recording material P (paper conveyance path) in duplex printing. However, in the image forming apparatus (printer) 1 of the present embodiment, the path switching gate 47 also has a function as a wind-shielding plate to block wind flowing from the outside into the fixing device 30 through the paper ejection opening 39. The function and operation will be described in the following.

Depending on a place where the printer 1 is provided, there is a case where wind from an air outlet of an air-conditioner or from an electric fan (or circulator) flows into an inner part from the paper ejection opening 39 of the printer 1 and a detection temperature in the temperature sensor 34 in the fixing device 30 and temperature adjustment control of the fixing roller 31 are influenced badly. More specifically, when the contactless temperature sensor 34 is cooled by the wind flowing from the outside, a detection temperature thereof becomes lower than an actual temperature. Thus, it becomes not possible for the control unit 60 to correctly perform feedback control (temperature adjustment control) of the fixing heater 33 based on the detection temperature. For example, a phenomenon that the detection temperature does not reach a target temperature even when the temperature adjustment control is performed for a predetermined period is generated.

In the printer 1 of the present embodiment, the path switching gate 47 is switched to the first position when the control unit 60 determines necessity thereof, whereby the terminal side of the main conveyance path R0 is closed, and the path switching gate 47 functions as a wind-shielding plate to block wind flowing from the outside into the fixing device 30 through the paper ejection opening 39. A detail example of control of switching the path switching gate 47 to the first position in a case where the control unit 60 determines necessity thereof will be described in the following.

Figure 2:
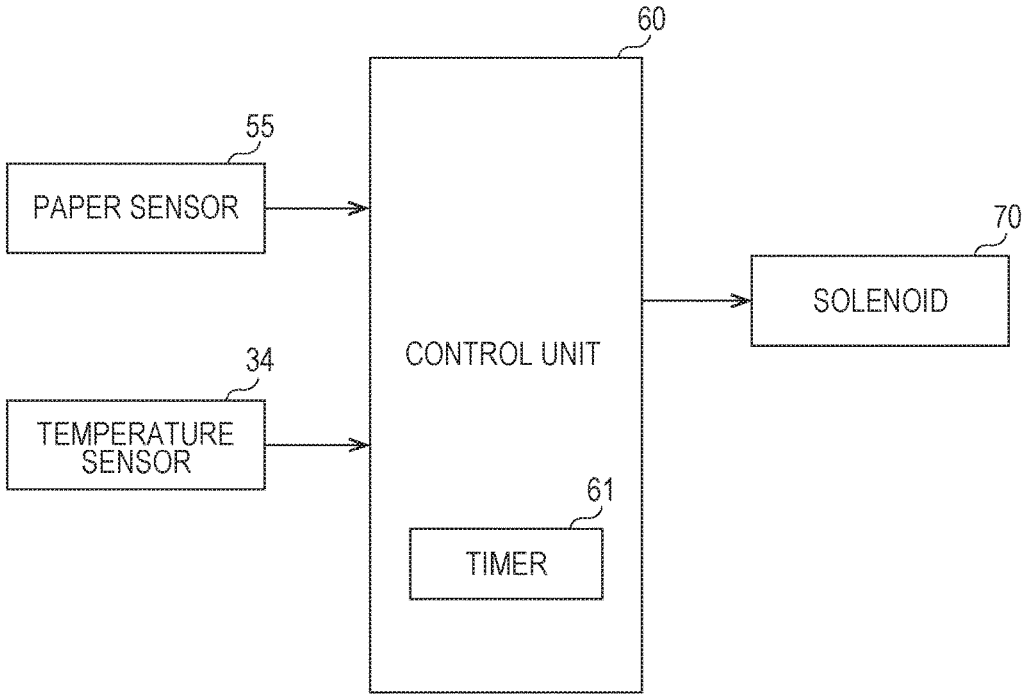
FIG. 2 is a block diagram illustrating a part, which is directly related to switching control of a path switching gate, among a control unit of the image forming apparatus and an electronic circuit therearound.

First, a part, which is directly related to the switching control of the path switching gate 47, among the control unit 60 and an electronic circuit therearound is illustrated as a block diagram in FIG. 2. The control unit 60 includes a microprocessor, a ROM for storing a program, a RAM for storing data, an input/output circuit (I/O), various timers for measuring timing 61, and the like. The detection signals from the paper sensors 55 and the temperature sensor 34 are input into the control unit 60. The control unit 60 performs switching control of the path switching gate 47 through the solenoid 70 based on these signals.

Figure 3:
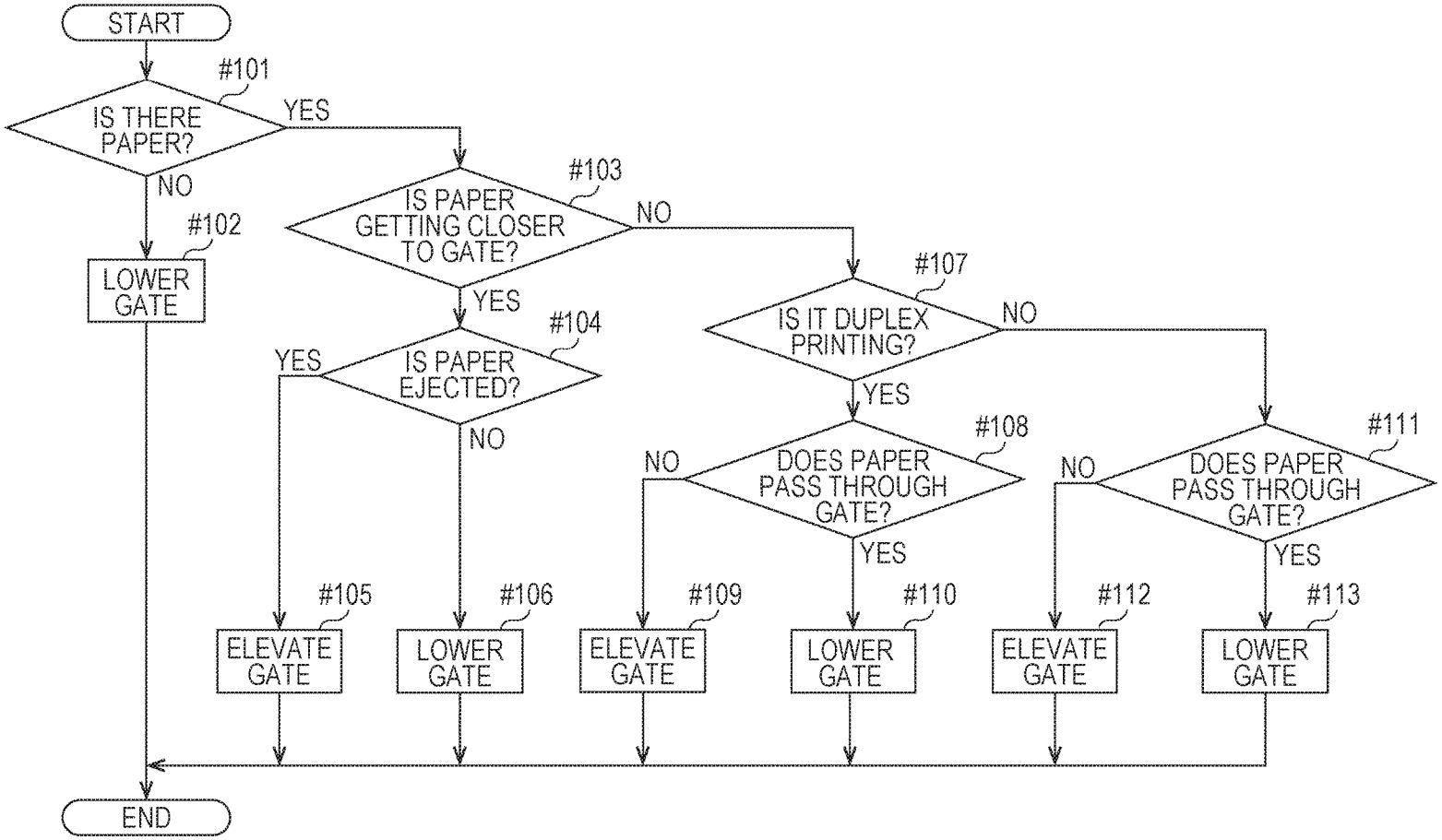
FIG. 3 is a flowchart illustrating a basic control example related to switching of the path switching gate.

FIG. 3 is a flowchart illustrating a basic control example related to switching of the path switching gate 47. In step #101, the control unit 60 determines whether the recording material (paper) P is in the paper conveyance path (paper feeding path R1, main conveyance path R0, and circulation conveyance path R2), that is, whether a printing operation is currently performed. As described above, the above determination is made based on the detection signals from the plurality of paper sensors 55 provided in the paper conveyance path. When there is not the paper P, the control unit 60 lowers the path switching gate 47 through the solenoid 70 in step #102. That is, switching to the first position is performed and wind from the outside into the fixing device 30 is blocked.

When it is determined in step #101 that there is the paper P, the control unit 60 determines in step #103 whether the paper P is getting closer to the path switching gate 47. When it is determined based on the detection signals from the paper sensors 55 and based on the built-in timer 61 that the paper P is brought, for example, to 5 mm before the path switching gate 47, the control unit 60 further determines in step #104 whether to eject the paper. That is, in a case of a single-sided printing mode or in a case of paper P on both surfaces of which printing is completed in a duplex printing mode (in case of ejecting paper), the path switching gate 47 is elevated through the solenoid 70 in step #105. That is, switching to the second position is performed and the paper P is ejected. In a case of paper P only on one surface of which printing is completed in the duplex printing mode, the path switching gate 47 is lowered through the solenoid 70 in step #106. That is, switching to the first position is performed and the paper P is conveyed toward the circulation conveyance path R2 (pair of reverse roller 41). Here, an effect in which the path switching gate 47 blocks the wind from the outside into the fixing device 30 is also acquired.

When it is determined in step #103 that the paper P is not getting closer to the path switching gate 47, the control unit 60 determines in step #107 whether the duplex printing is currently executed. In a case where the duplex printing is currently executed, the control unit 60 further determines in step #108 whether the paper P passes through the path switching gate 47. Until a rear end of the paper P passes through the path switching gate 47 and moves, for example, to a position at 20 mm in the circulation conveyance path R2, the second position in which the path switching gate 47 is elevated is kept (step #109). The path switching gate 47 is lowered after the passage (after movement) (step #110). That is, switching to the first position is performed and wind from the outside into the fixing device 30 is blocked.

When it is determined in step #107 that the duplex printing is not currently executed, the control unit 60 further determines in step #111 whether the paper P passes through the path switching gate 47. That is, in a case where the paper P is ejected in the single-sided printing, until a rear end thereof passes through the path switching gate 47 and moves, for example, to a position at 5 mm, the second position in which the path switching gate 47 is elevated is kept (step #112). The path switching gate 47 is lowered after the passage (after movement) (step #113). That is, switching to the first position is performed and wind from the outside into the fixing device 30 is blocked.

With the above-described switching control of the path switching gate 47, the path switching gate 47 is kept at the first position (lowered state) as long as possible other than a case where it is necessary to switch the path switching gate 47 to the second position (elevated state) for ejection of the recording material (paper) P or for conveyance thereof in the circulation conveyance path R2 (in case where paper P does not pass through path switching gate 47). Accordingly, it is possible to block the wind from the outside into the fixing device 30 and to prevent a had influence on a detection temperature of the temperature sensor 34 and the temperature adjustment control of the fixing roller 31.

As described above, the control unit 60 lowers the path switching gate 47 (perform switching to first position) by performing excitation (energization) of the solenoid 70 and elevates the path switching gate 47 (perform switching to second position) by stopping the excitation (energization) of the solenoid 70. However, an opposite relationship may be included in view of power saving. That is, the path switching gate 47 may be switched to the second position by excitation of the solenoid 70 and the path switching gate 47 may be switched to the first position by stopping of the excitation of the solenoid 70. In a case of the control in which the path switching gate 47 is kept at the first position when the paper P does not pass through the path switching gate 47, a period in which the first position is kept becomes longer.

In the basic control example illustrated in FIG. 3, the path switching gate 47 is switched to the first position with the paper P not passing through the path switching gate 47 as a condition. However, it is preferably added to the condition that the control unit 60 determines that a detection temperature in the temperature sensor 34 is influenced by wind. In an environment in which there is no problem in a position where the printer 1 is provided and wind from the outside does not influence the temperature sensor 34 of the fixing device 30 badly, feedback control of the fixing heater 33 based on a detection temperature of the temperature sensor 34 is performed normally even in a case where the path switching gate 47 is at the second position. Thus, the control unit 60 performs control in such a manner that the path switching gate 47 is switched to the first position in a case where it is determined that a detection temperature of the temperature sensor 34 is influenced by wind from the outside and where the paper P does not pass through the path switching gate 47.

Figure 4:
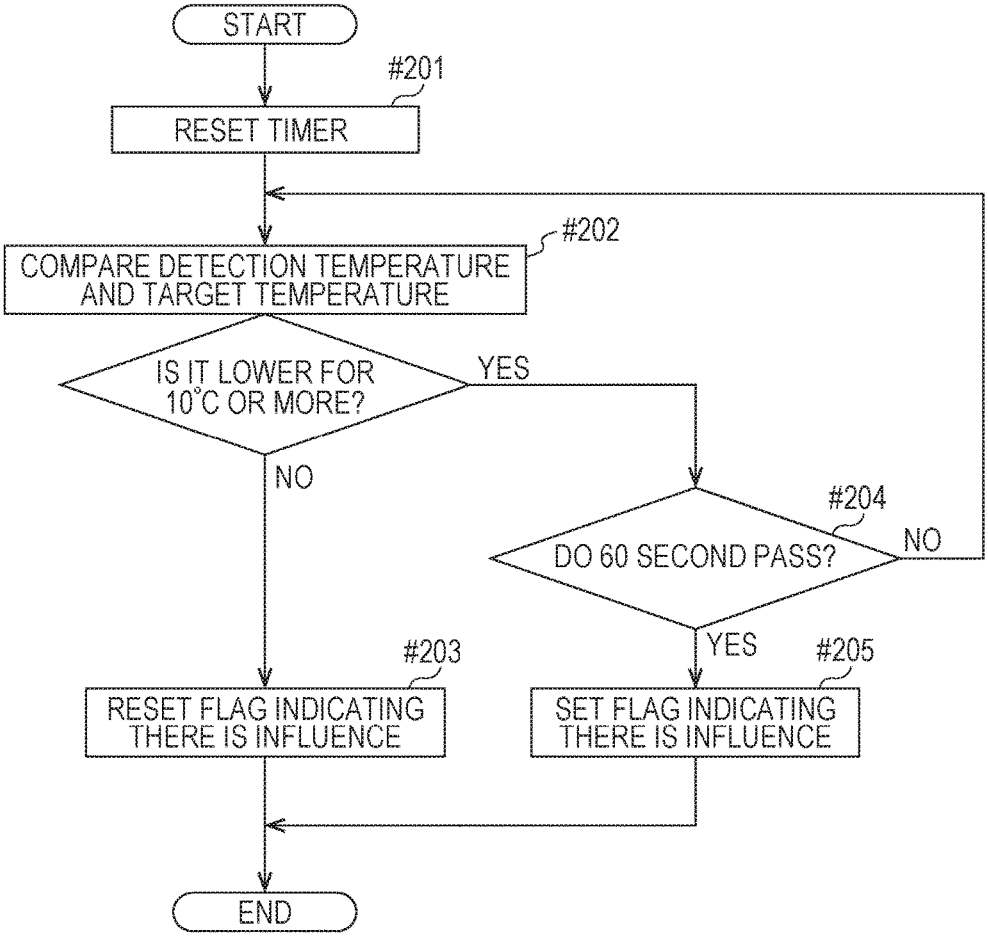
FIG. 4 is a flowchart illustrating an example of processing of determining whether a detection temperature of a temperature sensor is influenced by wind from the outside.

FIG. 4 is a flowchart illustrating an example of processing of determining whether a detection temperature of the temperature sensor 34 is influenced by wind from the outside. The control unit 60 makes this determination in a standby state of the printer 1 while performing the temperature adjustment control of the fixing device 30. The control unit 60 resets the built-in timer 61 in step #201 and compares a detection temperature of the temperature sensor 34 and a target temperature in step #202. It is determined whether the detection temperature is lower than the target temperature for 10° C. or more. When the detection temperature is not lower for 10° C., the control unit 60 resets a flag indicating there is an influence in step #203.

When the detection temperature is lower than the target temperature for 10° C. or more, the control unit 60 determines in step #204 whether 60 seconds pass in the built-in timer 61. When 60 seconds pass, the control unit 60 sets a flag indicating there is an influence in step #205. In a case within 60 seconds, the processing goes back to step #202 and the above processing is repeated.

As a result of the processing in FIG. 4, in a case where a state in which a detection temperature of the temperature sensor 34 is lower than the target temperature for 10° C. or more lasts for 60 seconds (one minute) or more when the temperature adjustment control of the fixing device 30 is performed in a standby state, the control unit 60 determines that the detection temperature of the temperature sensor 34 is influenced by wind from the outside and sets a flag indicating there is an influence. In other cases, the flag indicating there is an influence is reset. Then, when the processing of lowering the path switching gate 47 (switching to first position) is performed in the basic control example illustrated in FIG. 3 (step #102, 106, 110, and 113), it is checked whether the flag indicating there is an influence is set. Only when the flag is set, the path switching gate 47 is lowered (switched to first position). When the flag is not set, it is determined that there is no influence from wind from the outside. Thus, the path switching gate 47 is not lowered (is kept at second position).

Figure 5:
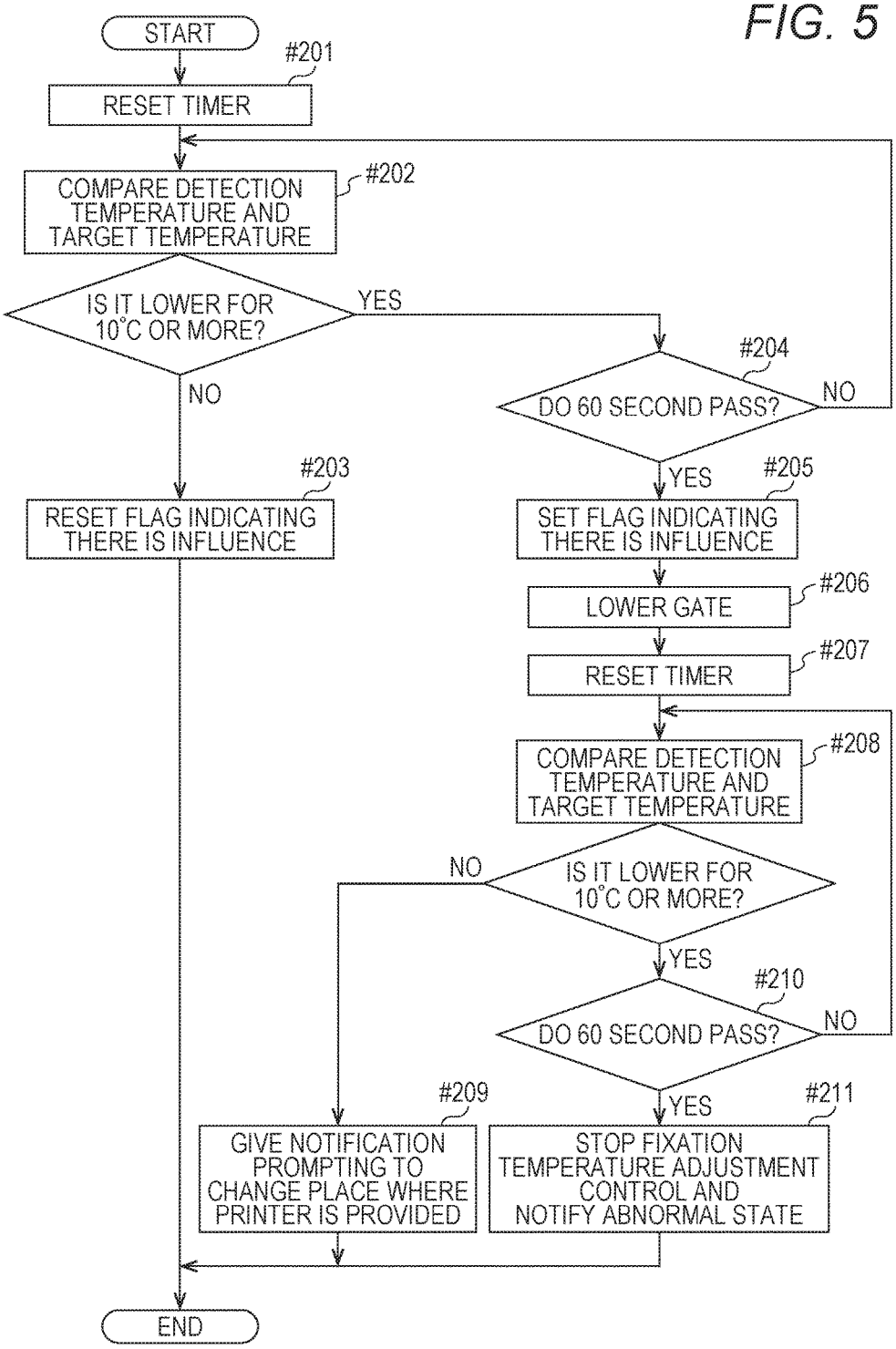
FIG. 5 is a flowchart illustrating a modification example of the determination processing illustrated in FIG. 4.

Next, FIG. 5 is a flowchart illustrating a modification example of the determination processing illustrated in FIG. 4. Processing up to step #205 is identical to that in the flowchart illustrated in FIG. 4. The control unit 60 that sets a flag indicating there is an influence in step #205 actually lowers the path switching gate 47 (perform switching to first position) in processing in and after step #206 and checks whether temperature adjustment control of the fixing device 30 is performed appropriately in a state in which there is no influence from wind from the outside.

First, the control unit 60 lowers the path switching gate 47 (perform switching to first position) in step #206, resets the built-in timer 61 in step #207, and compares a detection temperature of the temperature sensor 34 and a target temperature in step #208. It is determined whether the detection temperature is lower than the target temperature for 10° C. or more. When the detection temperature is not lower for 10° C. or more, the control unit 60 gives notification prompting to change a place where the printer 1 is provided in step #209. That is, it is possible to determine that a state becomes a state in which there is no (less) influence from the wind from the outside as a result of lowering of the path switching gate 47 (switching to first position) in step #206, notification prompting a user to move the printer 1 to a place where there is no (less) influence from the wind is given although it is possible to use the printer 1 by control of switching the path switching gate 47 and making the gate function as a wind-shielding plate. More specifically, such a message is displayed on a display unit of an operation panel. Alternatively, a predetermined LED is turned on (or is made to blink) or a buzzer may be turned on.

When the state in which the detection temperature is lower than the target temperature for 10° C. or more lasts in step #208, the control unit 60 determines in step #210 whether 60 seconds passes in the built-in timer 61. When 60 seconds pass, the control unit 60 stops temperature adjustment control of the fixing device 30 and notifies an abnormal state in step #211. That is, in a case where the state in which the detection temperature is lower than the target temperature for 10° C. or more lasts for 60 seconds (one minute) or longer even when the path switching gate 47 is lowered (switched to first position) in step #206, a different cause of a trouble such as a malfunction of the temperature sensor 34 is considered. Thus, the temperature adjustment control is stopped and the abnormal state is notified. The notification can be given with the display unit of the operation panel, an LED, a buzzer, or the like similarly to the notification in step #209.

In the above-described first embodiment of the present invention, the modification example arbitrarily described in the description is not the limitation and various modifications can be made. For example, in the image forming apparatus (printer) 1 illustrated in FIG. 1, the circulation conveyance path (reverse conveyance path) R2 includes the conveyance path for a switchback (pair of reverse roller 41) different from the paper ejection conveyance path (pair of ejection roller 42) that reaches the paper ejection opening 39 from the path switching gate 47. However, there is a printer in which the two are used in common. In such a printer, a pair of reverse rollers 41 (and paper exit/entrance and housing tray 51 thereof) is not provided and a pair of ejection rollers 42 also functions as the pair of reverse rollers 41. Then, in a case where a switchback of paper is performed, a path switching gate is switched and the paper is conveyed to a reverse conveyance path. An embodiment of the present invention can be also applied to such a printer. However, in a case of such a printer, even when wind from the outside flows into an inner part of the printer through a paper ejection opening, the most of the wind flows into the reverse conveyance path. Thus, there is a small influence on (temperature sensor 34 of) a fixing device 30. Thus, an embodiment of the present invention is very effective in a case of being applied to an image forming apparatus having a configuration, in which a circulation conveyance path R2 includes a conveyance path for a switchback (pair of reverse roller 41) separately from a paper ejection conveyance path (pair of ejection roller 42) that reaches a paper ejection opening 39 from a path switching gate 47, similarly to the printer 1 illustrated in FIG. 1.

Furthermore, as described above, in the printer 1 illustrated in FIG. 1, it is possible to eject a recording material P, on which printing is already performed, onto the housing tray 51 by rotational driving of the pair of reverse rollers 41. Thus, in step #105 in the basic control example illustrated in FIG. 3, control of lowering the path switching gate 47 (switching to first position) may be performed similarly to step #106 and the recording material P on which printing is already performed may be ejected onto the housing tray 51 instead of elevation of the path switching gate 47 (switching to second position). Accordingly, it is possible to keep the path switching gate 47 at the first position (position of blocking wind) for a longer period and to further decrease possibility that wind influences (temperature sensor 34 of) the fixing device 30 badly.

Furthermore, in the basic control example illustrated in FIG. 3, when the control unit 60 performs processing of lowering the path switching gate 47 (switching to first position), switching back to the second position may be performed in a predetermined period and control of repeatedly performing switching between the first position and the second position in a predetermined cycle may be performed. As described above, when the control unit 60 lowers the path switching gate 47 (perform switching to first position) by exciting the solenoid 70, it is possible to reduce power consumption of the solenoid 70 in a case where switching between the first position and the second position is repeatedly performed in a predetermined cycle compared to a case where the first position is kept continuously. There is also an effect of reducing heat generated by the solenoid 70.

Next, an image forming apparatus according to a second embodiment of the present invention will be described. In the image forming apparatus of the first embodiment, a path switching gate that switches a conveyance path of paper during duplex printing is controlled and used to block wind flowing into a fixing device from the outside. However, in the image forming apparatus of the second embodiment, a postprocessing tray of a sheet postprocessing device is controlled and used to block wind flowing into a fixing device from the outside.

Figure 6:
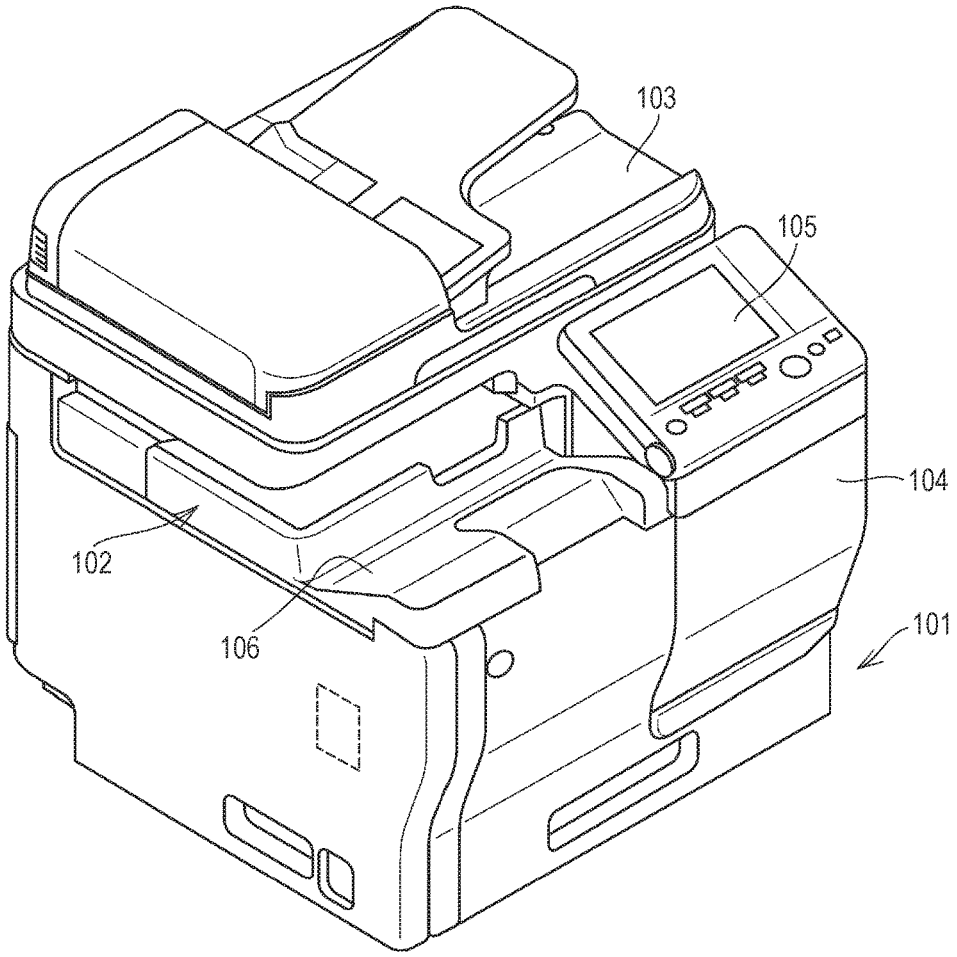
FIG. 6 is a perspective view illustrating an outer appearance of an image forming apparatus, to which a sheet postprocessing device is mounted, according to a second embodiment of the present invention.

FIG. 6 is a perspective view illustrating an outer appearance of an image forming apparatus 101, to which a sheet postprocessing device is mounted, according to the second embodiment. The image forming apparatus 101 includes a scanner unit 103, a printer unit 104, and an operation unit 105. In a space between the scanner unit 103 and the printer unit 104, a sheet postprocessing device 102 is mounted. The image forming apparatus 101 is a so-called multi-function printer and has not only a printer (printing) function but also a scanner function of reading a manuscript with the scanner unit 103 and generating image data, a copier function of duplicating a manuscript by printing image data thereof, a facsimile function of transmitting/receiving an image through a telephone line, and the like.

The sheet postprocessing device 102 bundles a plurality of pieces of paper ejected from a paper ejection opening of the printer unit 104, performs stapling processing, and outputs the processed paper bundle to a front tray 106. A configuration of the printer unit 104 is similar to the configuration of the printer 1 described in the first embodiment. The paper ejection opening 39 in FIG. 1 is in a right end part of the space between the scanner unit 103 and the printer unit 104, that is, in the back of a left side surface of an operation unit 105 in FIG. 6. In the following, a schematic operation of the sheet postprocessing device 102 will be described.

Figure 7:
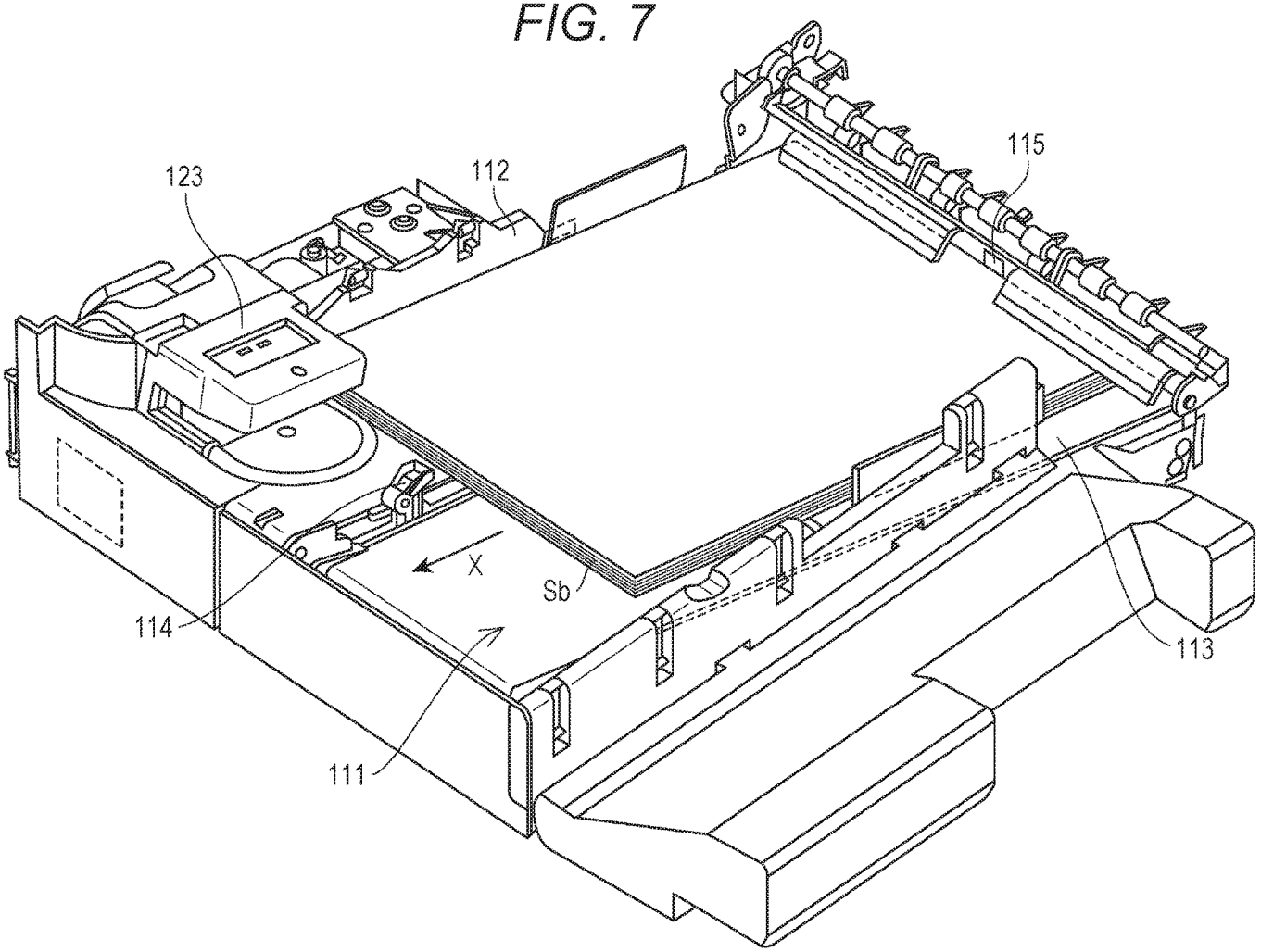
FIG. 7 is a perspective view illustrating a first operation state of the sheet postprocessing device.

FIG. 7 is a perspective view illustrating a first operation state of the sheet postprocessing device 102. In this drawing, a state in which a plurality of pieces of paper Sb ejected from a paper ejection opening of the printer unit 104 is aligned and plied on a postprocessing tray 111 is illustrated. That is, end parts in front and rear directions of the plurality of pieces of paper Sb that is serially ejected from an upper right direction in FIG. 7 onto the postprocessing tray 111 are aligned by an FD alignment member 114 and end parts in a width direction are aligned by a CD alignment plate 113.

Figure 8:
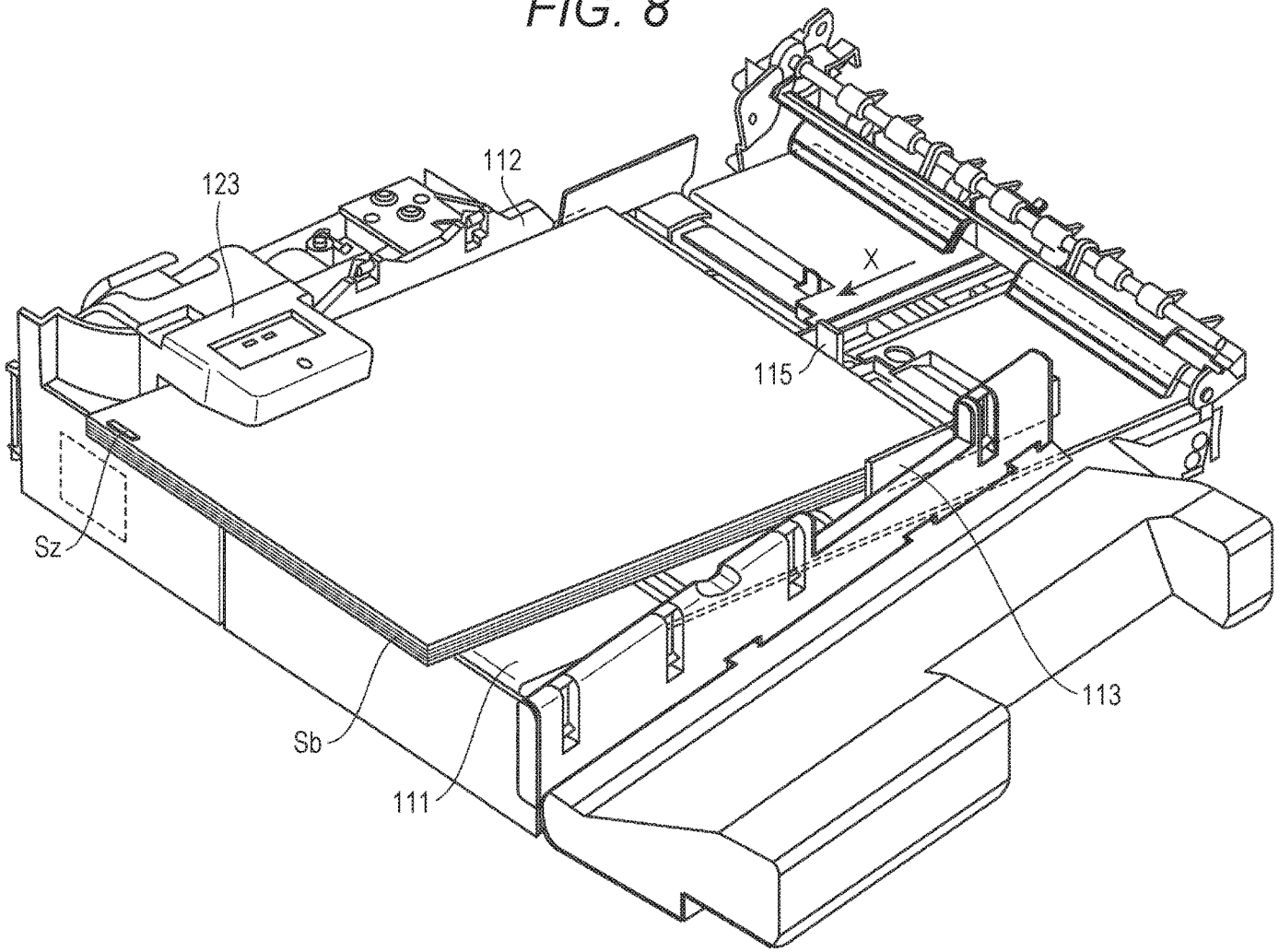
FIG. 8 is a perspective view illustrating a second operation state of the sheet postprocessing device.

Then, the FD alignment member 114 moves in a direction indicated by an arrow X and retreats under a surface of the postprocessing tray 111 (go back to hone position). Then, an FD conveyance member 115 is moved from a home position in the direction indicated by the arrow X and the plurality of pieces of paper Sb sandwiched between a CD reference plate 112 and the CD alignment plate 113 is conveyed in the direction indicated by the arrow X to a stapling position in a stapler 123. When stapling is executed by the stapler 123, the plurality of pieces of paper in a bundle (paper bundle) Sb is further conveyed in the direction indicated by the arrow X by the FD conveyance member 115. This state is illustrated as a second operation state in FIG. 8. A state in which the paper bundle Sb is stapled with a staple Sz is illustrated.

Figure 9:
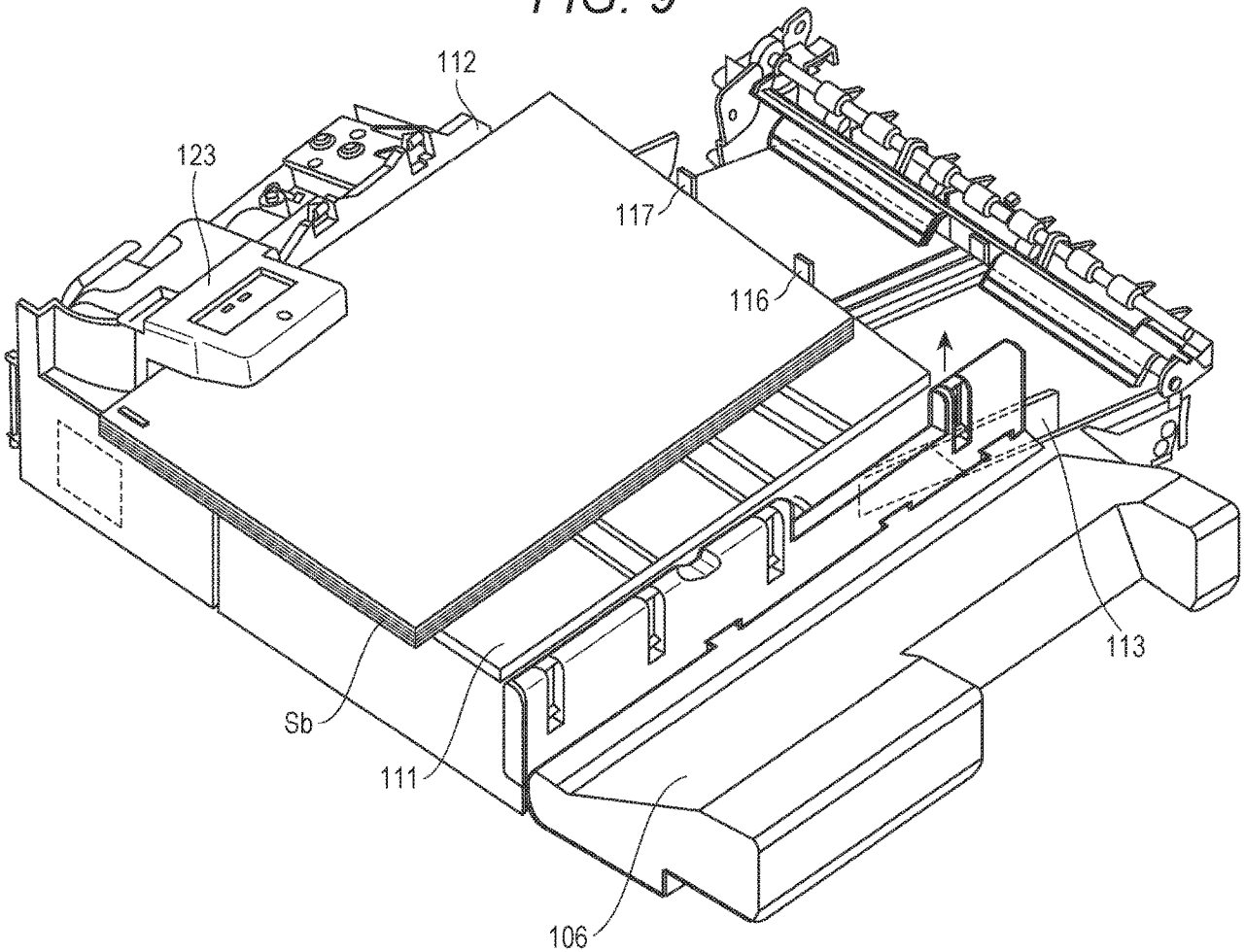
FIG. 9 is a perspective view illustrating a third operation state of the sheet postprocessing device.
Figure 10:
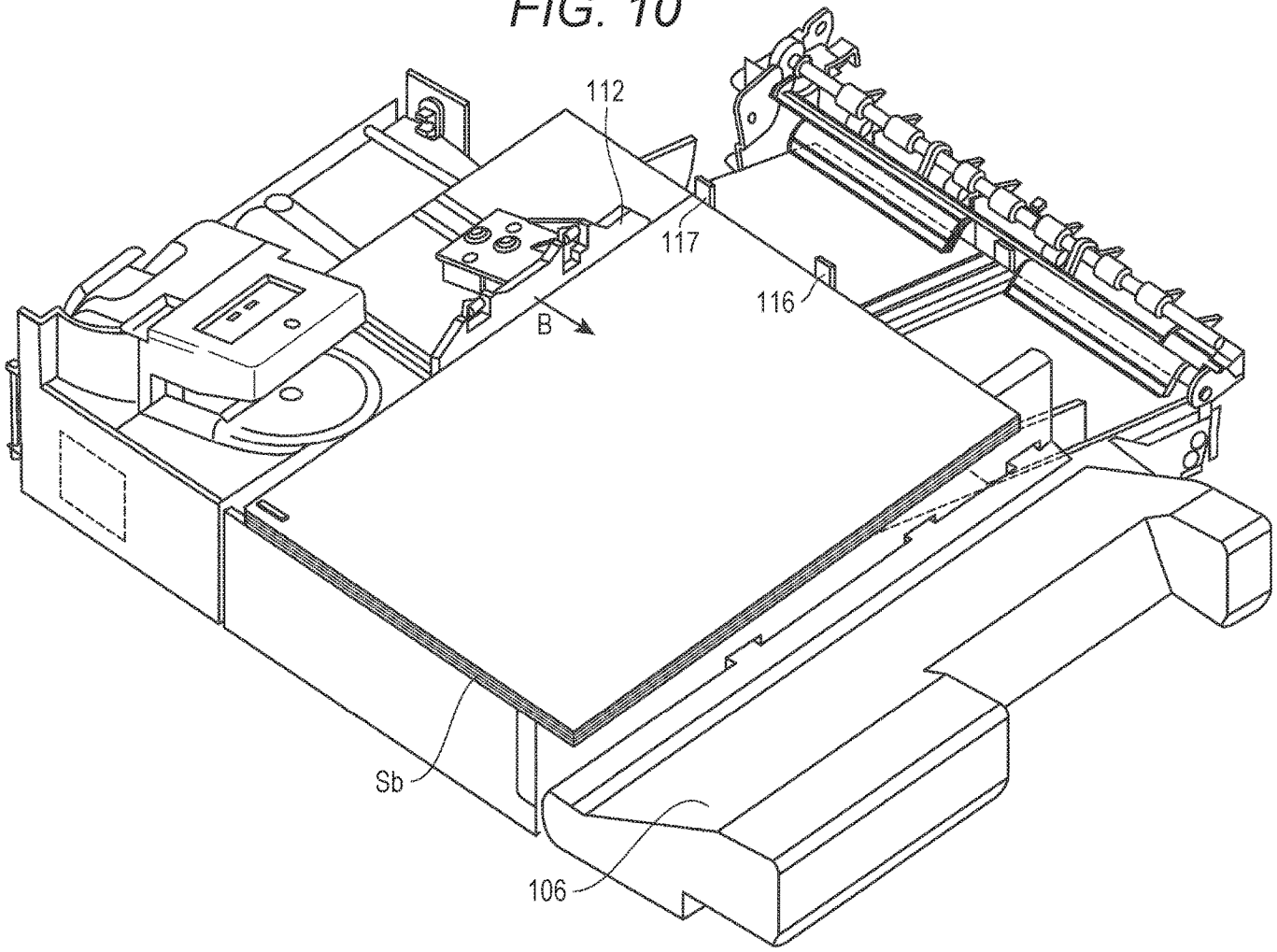
FIG. 10 is a perspective view illustrating a fourth operation state of the sheet postprocessing device.

Then, as illustrated as a third operation state in FIG. 9, guide claws 116 and 117 protrude from a rear end part of the postprocessing tray 111 and hold a rear end part of the paper bundle Sb instead of the FD conveyance member 115. The postprocessing tray 111 swings to an elevated position. That is, a rear end side is elevated with a front end side as a center and the postprocessing tray 111 is switched from an inclined position (lowered position) to a horizontal position (elevated position). Then, as illustrated as a fourth operation state in FIG. 10, the paper bundle Sb is pushed by the CD reference plate 112 in a direction of an arrow B toward the front tray 106 and is output to the front tray 106. Then, the CD reference plate 112 goes back to the home position and the postprocessing tray 111 goes back to the lowered position (inclined position).

As described above, the postprocessing tray 111 of the sheet postprocessing device 102 is at the lowered position until the plurality of pieces of paper Sb ejected from the paper ejection opening of the printer unit 104 is received and the stapling processing is executed. Then, in a case of outputting the paper bundle Sb to the front tray 106, the postprocessing tray 111 is temporarily at the elevated position and goes back to the lowered position when the output is over. This is an original (conventional) operation of the postprocessing tray 111. In the image forming apparatus of the present embodiment, this postprocessing tray 111 is also used as a unit of blocking wind flowing from the paper ejection opening of the printer unit 104 into the fixing device (which unit correspond to path switching gate 47 in first embodiment).

That is, when the postprocessing tray 111 is at the lowered position, wind from the outside easily flows from the paper ejection opening of the printer unit 104 into an inner part (fixing device). However, when the postprocessing tray 111 is at the elevated position, it becomes difficult for the wind from the outside to flow from the paper ejection opening of the printer unit 104 into the inner part. Thus, a control unit 60 of the printer unit 104 performs switching control of the postprocessing tray similarly to the switching control of the path switching gate described in the first embodiment. Note that an inner configuration of the printer unit 104 is similar to the inner configuration of the printer 1 in the first embodiment and a reference number identical to that of the first embodiment is assigned to each configuration element in the following description.

Figure 11:
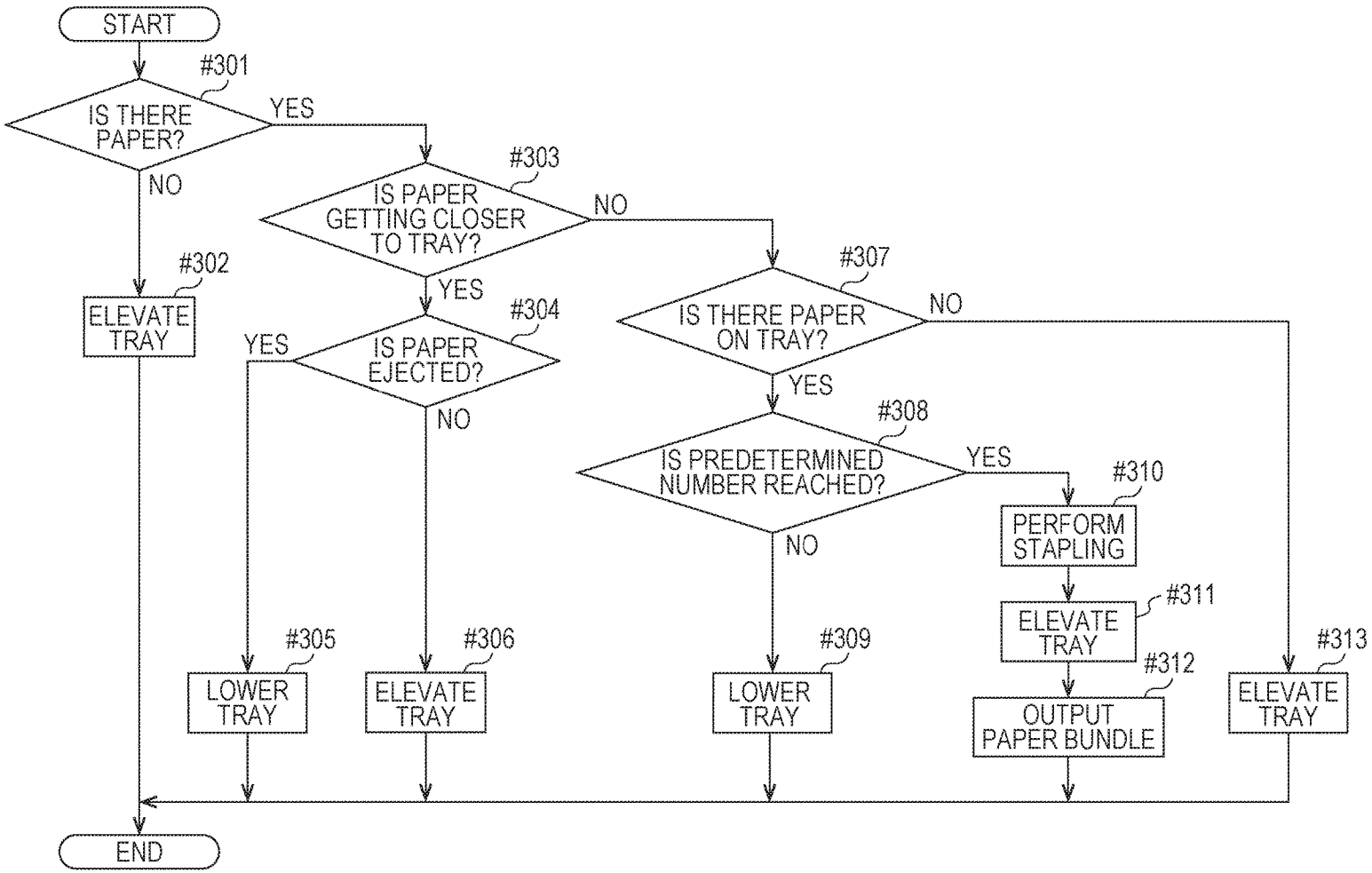
FIG. 11 is a flowchart illustrating a basic control example related to switching of a postprocessing tray of the sheet postprocessing device.

FIG. 11 is a flowchart illustrating a basic control example related to switching of the postprocessing tray 111 of the sheet postprocessing device 102. In step #301, the control unit 60 determines whether paper is in a paper conveyance path (paper feeding path R1, main conveyance path R0, and circulation conveyance path F2), that is, whether a printing operation is currently performed. As described above, the above determination is made based on detection signals from a plurality of paper sensors 55 provided in the paper conveyance path. When there is no paper, the control unit 60 elevates the postprocessing tray 111 in step #302. That is, switching to the elevated position is performed and it is made difficult for wind from the outside to flow into the inner part from the paper ejection opening.

When it is determined in step #301 that there is paper, the control unit 60 determines in step #303 whether the paper is getting closer to the postprocessing tray 111. When it is determined based on the detection signals from the paper sensor 55 and based on a built-in timer 61 that the paper is brought, for example, to 20 mm before the postprocessing tray 111, the control unit 60 further determines in step #304 whether to eject the paper. That is, in a case of a single-sided printing mode or in a case of paper on both surfaces of which printing is completed in a duplex printing mode (in case of ejecting paper), the postprocessing tray 111 is lowered in step #305. That is switching to the lowered position is performed and the paper is ejected to the postprocessing tray 111 (sheet postprocessing device 102). In a case of paper only on one surface of which printing is completed in a duplex printing mode (in case where paper is not ejected), the postprocessing tray 111 is elevated in step #306. That is, switching to the elevated position is performed and it is made difficult for wind from the outside to flow into the inner part from the paper ejection opening.

When it is determined in step #303 that the paper is not getting closer to the postprocessing tray 111, the control unit 60 determines in step #307 whether there is paper on the postprocessing tray 111. When there is paper on the postprocessing tray 111, the control unit 60 further determines in step #308 whether the number of pieces of paper on the postprocessing tray 127 reaches a predetermined number (number to execute stapling processing). Until the predetermined number is reached, the postprocessing tray 111 is switched to (kept at) the lowered position in step #309. When the predetermined number is reached, the stapling processing is executed in step #310, the postprocessing tray 111 is switched to the elevated position in step #311, and a paper bundle is output in step #312. When it is determined in step #307 that there is no paper on the postprocessing tray 111, the control unit 60 switches the postprocessing tray 111 to the elevated position and makes it difficult for the wind from the outside to flow into the inner part from the paper ejection opening.

With the above-described switching control of the postprocessing tray 111, the postprocessing tray 111 is kept at the elevated position as long as possible other than a case where it is necessary to switch the postprocessing tray 111 to the lowered position for ejection of paper. Accordingly, it is made difficult for wind from the outside to flow into the inner part from the paper election opening. As a result, it is possible to prevent the wind from influencing a detection temperature of a temperature sensor 34 and temperature adjustment control of a fixing roller 31 badly.

Control based on a detection temperature of the temperature sensor 31 which control is described in the first embodiment, that is, processing of determining whether a detection temperature of the temperature sensor 34 is influenced by wind from the outside and of setting/resetting a flag indicating there is an influence which processing is illustrated as an example in FIG. 4 can be also applied to the present embodiment. In that case, when the processing of switching the postprocessing tray 111 to the elevated position in the basic control example illustrated in FIG. 11 (step #302, 306, 311, and 313), it is checked whether a flag indicating there is an influence is set. Only when the flag is set, the postprocessing tray 111 is switched to the elevated position. Furthermore, each processing described in the first embodiment such as the processing in FIG. 5 which processing is a modification example of the determination processing illustrated as an example in FIG. 4 can be also applied to the present embodiment when there is no problem or can be applied thereto with an arbitrary modification.

In the above, embodiments of the present invention and a modification example thereof have been described. However, a shape, a structure, or the like of each part is not limited to what has been described in detail with reference to the drawings and various modifications can be made within the spirit and the scope of the present invention.

According to an embodiment of the present invention, in an image forming apparatus described in Item. 1, it is possible to prevent a bad influence of wind, which flows from a paper ejection opening into a fixing device, on a temperature sensor and to perform temperature adjustment control of the fixing device correctly based on temperature detection by a temperature sensor since a position of a conveyance guide provided in a conveyance path of paper is controlled by a control unit and a position thereof is switched to a position of blocking wind in a case where paper does not pass through the conveyance guide. In addition, since the conveyance guide is also used as a wind-shielding plate, it is possible to acquire the above-described effect only with a change in a control program of a control unit without adding a new member.

According to an image forming apparatus described in Item. 2, a drive unit (such as electromagnetic solenoid) of a conveyance guide is energized and a position is changed only when necessity thereof is determined based on a detection temperature of a temperature sensor since a position of the conveyance guide is switched to a position of blocking wind in a case where it is determined that a detection temperature of the temperature sensor is influenced by wind and paper does not pass through the conveyance guide. Accordingly, it is possible to control power consumed to prevent wind, which flows from the paper ejection opening into the fixing device, from influencing the temperature sensor badly.

According to an image forming apparatus described in Item. 3, it is possible to block wind flowing from a paper ejection opening into a fixing device without adding a new member by using, as a wind-shielding plate, a path switching gate that can be switched between a first position for conveying paper after single-sided printing to a reverse conveyance path and a second position for conveying paper after duplex printing to a paper ejection opening during duplex printing.

According to an image forming apparatus described in Item. 4, it is possible to block wind flowing from a paper ejection opening into a fixing device (without adding new member) by using, as a wind-shielding plate, a postprocessing tray of a sheet postprocessing device that is provided on an outer side of a paper ejection opening and that performs predetermined postprocessing (such as stapling processing) on a plurality of pieces of ejected paper and by switching the postprocessing tray to an elevated position.

According to an image forming apparatus described in Item. 5, it is possible to control power consumed to prevent wind, which flows from a paper ejection opening into a fixing device, from influencing a temperature sensor badly since temperature adjustment control of a fixing device is performed in a standby state of the image forming apparatus, it is determined that a detection temperature of a temperature sensor is influenced by the wind in a case where a state in which the detection temperature of the temperature sensor is lower than a target temperature for a predetermined temperature lasts for a predetermined period, and a drive unit (such as electromagnetic solenoid) of a conveyance guide is energized and a position is switched only when necessity thereof is determined as described above.

According to an image forming apparatus described in Item. 6, it is possible for a user of the image forming apparatus to move the image forming apparatus to a more appropriate position where an influence of wind from the outside is the small since a position of a conveyance guide is switched to a position of blocking wind in a case where it is determined that a detection temperature of a temperature sensor is influenced by the wind and it is prompted, with a display unit or an alarm unit, to change a place where the image forming apparatus is provided when a detection temperature of the temperature sensor reaches a target temperature in a predetermined period thereafter.

According to an image forming apparatus described in Item. 7, since temperature adjustment control of a fixing device is stopped and an abnormal state is notified with a display unit or an alarm unit in a case where a detection temperature of a temperature sensor does not reach a target temperature even in a predetermined period after a position of a conveyance guide is switched to a position of blocking wind, it is possible to prevent operation (energization) of a fixing device from being continuously performed in an abnormal state such as a temperature sensor malfunction and it is possible for a user of the image forming apparatus to perform appropriate treatment according to the notification.

According to an image forming apparatus described in Item. 8, a reverse conveyance path includes a conveyance path for a switchback which path is different from a paper ejection conveyance path that reaches a paper ejection opening from a path switching gate. There is an image forming apparatus having a structure in which a paper ejection conveyance path that reaches a paper ejection opening from a path switching gate is also used as a conveyance path for a switchback in a reverse conveyance path. In this case, wind flowing from a paper ejection opening easily flows to a side of the reverse conveyance path and there is small had influence on a fixing device. On the other hand, in a configuration in which a conveyance path for a switchback is included separately from a paper ejection conveyance path, for example, in a configuration in the image forming apparatus described in Item. 8, wind flowing from a paper election opening likely to influence (temperature sensor of a fixing device badly. Thus, in such a configuration, an embodiment of the present invention is more effective in the above-described manner.

According to an image forming apparatus described in Item. 9, in the above configuration (in Item. 8), a control unit keeps a conveyance guide at a first position and ejects paper from an opening in the conveyance path for a switchback under a predetermined condition. Thus, it is possible to keep the conveyance guide at a position of blocking wind (first position) even at timing of ejecting the paper and to further reduce possibility that the wind influences (temperature sensor of) the fixing device badly.

According to an image forming apparatus described in Item. 10, it is possible to decrease power consumption of a drive unit (solenoid) compared to a case where a path switching gate is continuously kept at a first position since a control unit performs switching back to a second position in a predetermined period when switching the path switching gate to the first position and repeatedly performs switching between the first position and the second position in a predetermined cycle.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming device that forms an image on a sheet;

a fixing device that fixes the image to the sheet;

a temperature sensor that detects a temperature of the fixing device;

a conveyance guide located at a predetermined position that blocks wind flowing into the fixing device;

a photosensor that detects presence of the sheet along a sheet conveyance path;

a reverse conveyance path;

a paper ejection opening; and a microprocessor that controls the conveyance guide to move from the predetermined position based on a detection result of the photosensor, wherein the conveyance guide is a path switching gate that conveys the sheet to the reverse conveyance path when being at a first position and conveys the sheet to the paper ejection opening when being at a second position, and wherein the predetermined position is the first position.

2. The image forming apparatus according to claim 1, wherein:

the microprocessor controls the conveyance guide to move to the predetermined position based on the detection result of the photosensor and a detection temperature of the temperature sensor.

3. An image forming apparatus comprising:

an image forming device that forms an image on a sheet;

a fixing device that fixes the image to the sheet;

a temperature sensor that detects a temperature of the fixing device;

a conveyance guide located at a predetermined position that blocks wind flowing into the fixing device;

a photosensor that detects presence of the sheet along a sheet conveyance path;

a paper ejection opening; and a microprocessor that controls the conveyance guide to move from the predetermined position based on a detection result of the photosensor, wherein:

the conveyance guide is a tray of a postprocessing device that performs predetermined postprocessing on the sheet ejected from the paper ejection opening;

the postprocessing device receives the sheet ejected from the paper ejection opening when being at a lowered position and performs the predetermined postprocessing at an elevated position; and the predetermined position is the elevated position.

4. The image forming apparatus according to claim 2, wherein:

the microprocessor controls the conveyance guide to move to the predetermined position in a case where a state in which the detection temperature is lower than a target temperature lasts for a predetermined period.

5. The image forming apparatus according to claim 4, further comprising an alarm, wherein:

the microprocessor prompts, with the alarm, to change a place where the image forming apparatus is provided in a case where the detection temperature reaches the target temperature in a predetermined period after the conveyance guide is moved to the predetermined position.

6. The image forming apparatus according to claim 4, further comprising an alarm, wherein:

the microprocessor stops a temperature adjustment of the fixing device and notifies an abnormal state with the alarm in a case where the detection temperature does not reach the target temperature in a predetermined period after the conveyance guide is moved to the predetermined position.

7. The image forming apparatus according to claim 1, further comprising a conveyance path for a switchback.

8. The image forming apparatus according to claim 7, further comprising a paper exit/entrance of the conveyance path for a switchback, wherein:

the conveyance guide is kept at the first position under a predetermined condition and the sheet is ejected from the paper exit/entrance.

9. The image forming apparatus according to claim 1, wherein:

the microprocessor controls to perform switching of the conveyance guide in a predetermined cycle.

10. The image forming apparatus according to claim 1, wherein:

the microprocessor controls to move, based on the detection result of the photosensor, the path switching gate to the first position after a rear end of the sheet moves for 20 mm after passing through the path switching gate.

11. The image forming apparatus according to claim 1, further comprising a solenoid, wherein:

the microprocessor controls to move the path switching gate to the second position by performing energization of the solenoid and to move the path switching gate to the first position by stopping the energization of the solenoid.

12. An image forming apparatus comprising:

an image forming device that forms an image on a sheet;

a fixing device that fixes the image to the sheet;

a temperature sensor that detects a temperature of the fixing device;

a conveyance guide located at a predetermined position that blocks wind flowing into the fixing device;

a photosensor that detects presence of the sheet along a sheet conveyance path;

an alarm; and a microprocessor, wherein:

the microprocessor controls the conveyance guide to move from the predetermined position based on a detection result of the photosensor, the microprocessor controls the conveyance guide to move to the predetermined position based on the detection result of the photosensor and a detection temperature of the temperature sensor, the microprocessor controls the conveyance guide to move to the predetermined position in a case where a state in which the detection temperature is lower than a target temperature lasts for a predetermined period, and the microprocessor prompts, with the alarm, to change a place where the image forming apparatus is provided in a case where the detection temperature reaches the target temperature in a predetermined period after the conveyance guide is moved to the predetermined position.

* * * * *